US011172805B2

(12) United States Patent
Persson

(10) Patent No.: US 11,172,805 B2
(45) Date of Patent: Nov. 16, 2021

(54) METHOD AND AN APPLIANCE FOR WASHING AND RINSING GOODS SENSITIVE TO TEMPERATURE CHANGES

(71) Applicant: ELECTROLUX APPLIANCES AKTIEBOLAG, Stockholm (SE)

(72) Inventor: David Persson, Stockholm (SE)

(73) Assignee: Electrolux Appliances Aktiebolag

( * ) Notice: Subject to any disclaimer, the term of this patent is extended or adjusted under 35 U.S.C. 154(b) by 0 days.

(21) Appl. No.: 16/626,628

(22) PCT Filed: Jul. 5, 2017

(86) PCT No.: PCT/EP2017/066776
§ 371 (c)(1),
(2) Date: Dec. 26, 2019

(87) PCT Pub. No.: WO2019/007498
PCT Pub. Date: Jan. 10, 2019

(65) Prior Publication Data

US 2020/0221923 A1 Jul. 16, 2020

(51) Int. Cl.

| | |
|---|---|
| ***A47L 15/42*** | (2006.01) |
| ***A47L 15/00*** | (2006.01) |
| ***A47L 15/46*** | (2006.01) |

(52) U.S. Cl.
CPC ..... *A47L 15/4285* (2013.01); *A47L 15/0007* (2013.01); *A47L 15/0023* (2013.01);
(Continued)

(58) Field of Classification Search
CPC ..... A47L 15/0007; A47L 15/0023; A47L 15/0026; A47L 15/0065; A47L 15/4219;
(Continued)

(56) References Cited

U.S. PATENT DOCUMENTS 3,718,149 A 2/1973 Mazza
5,006,767 A * 4/1991 Maruyama ..... A47L 15/0078 134/57 D (Continued)

FOREIGN PATENT DOCUMENTS

DE 199 40 162 A 3/2001
JP H02-29231 A * 1/1990

(Continued)

OTHER PUBLICATIONS

Machine translation of JPH02-29231A (Year: 1990).*
International Search Report and Written Opinion for Application No. PCT/EP2017/066776 dated Mar. 8, 2018, 15 pages.

*Primary Examiner* — Douglas Lee
(74) *Attorney, Agent, or Firm* — RatnerPrestia

(57) ABSTRACT

Provided are a method performed by an appliance for washing and rinsing goods, where some of the goods loaded into the appliance are sensitive to process water temperature changes, and an appliance performing the method. The method may include receiving via a user interface, an instruction that an appliance, during execution of a general-type washing program, should take into account that goods sensitive to temperature changes are loaded into the appliance, measuring a temperature value in a washing compartment of the appliance upon executing a draining process, and supplying fresh water to the washing compartment of the appliance. The method may include measuring, when the fresh water has been supplied, whether the process water being accommodated in a sump of the appliance is at a target temperature value or not and if not adjusting the temperature of the process water in the sump to attain the target temperature value.

14 Claims, 4 Drawing Sheets

(52) U.S. Cl.
CPC ..... *A47L 15/0026* (2013.01); *A47L 15/0065* (2013.01); *A47L 15/4219* (2013.01); *A47L 15/4287* (2013.01); *A47L 15/4297* (2013.01); *A47L 15/46* (2013.01); *A47L 2301/04* (2013.01); *A47L 2401/12* (2013.01); *A47L 2401/18* (2013.01); *A47L 2501/01* (2013.01); *A47L 2501/03* (2013.01); *A47L 2501/06* (2013.01); *A47L 2501/36* (2013.01)

(58) Field of Classification Search
CPC ..... A47L 15/4285; A47L 15/4287; A47L 15/4297; A47L 15/46; A47L 2301/04; A47L 2401/12; A47L 2401/18; A47L 2501/01; A47L 2501/03; A47L 2501/06; A47L 2501/36
See application file for complete search history.

(56) References Cited

U.S. PATENT DOCUMENTS

| | | | | | |
|---|---|---|---|---|---|
| 5,264,043 | A * | 11/1993 | Milocco | ..... | A47L 15/0049 134/108 |
| 2008/0314423 | A1* | 12/2008 | Berends | ..... | A47L 15/4293 134/57 D |
| 2012/0145194 | A1* | 6/2012 | Jerg | ..... | A47L 15/4285 134/10 |

FOREIGN PATENT DOCUMENTS

| | | | |
|---|---|---|---|
| JP | H07 41015 | B2 | 5/1995 |
| WO | WO 2011/080232 | A1 | 7/2011 |

* cited by examiner

METHOD AND AN APPLIANCE FOR WASHING AND RINSING GOODS SENSITIVE TO TEMPERATURE CHANGES

CROSS-REFERENCE TO RELATED APPLICATIONS

This application is a national stage application filed under 35 U.S.C. § 371 of International Application No. PCT/EP2017/066776 filed Jul. 5, 2017 and published as WO2019007498, which application is hereby incorporated by reference herein in its entirety.

TECHNICAL FIELD

The invention relates to a method performed by an appliance for washing and rinsing goods, where some of the goods loaded into the appliance are sensitive to process water temperature changes, and an appliance performing the method.

BACKGROUND

Dishwasher programmes especially designed for delicate goods to be washed, such as glassware, are known in the art. There are many aspects to consider preventing delicate goods from being damaged, but one critical parameter to control is avoiding rapid temperature changes (i.e. spraying cold water on hot fragile glassware, or hot water on cold fragile glassware).

With dedicated glass washing programmes this is easily handled, since the temperature profile of the glass washing programme is predefined.

However, a downside to using these specific washing programmes is that a user tends to load one or two handfuls of fragile glasses into the dishwasher and then run the programme, which is undesired from an environmental point of view.

SUMMARY

An objective of the invention is to solve, or at least mitigate, this problem in the art, and to provide an improved appliance for washing and rinsing goods, where some of the goods loaded into the appliance are sensitive to process water temperature changes.

This objective is attained in a first aspect of the invention by a method performed by an appliance for washing and rinsing goods, where some of the goods loaded into the appliance are sensitive to process water temperature changes. The method comprises receiving via a user interface, an instruction to execute a general-type washing programme, and a further instruction that the appliance during execution of the general-type washing programme should take into account that goods sensitive to temperature changes are loaded into the appliance, measuring a temperature value in a washing compartment of the appliance upon executing a draining process, and supplying fresh water to the washing compartment of the appliance. The method further comprises measuring, when the fresh water has been supplied, whether the process water being accommodated in a sump of the appliance is at a target temperature value or not, the target temperature value being defined to assume a value in a predetermined temperature range around the temperature value in the washing compartment measured during the draining process, and if not adjusting the temperature of the process water in the sump to attain the target temperature value, wherein the process water can be applied to the goods being sensitive to process water temperature changes.

This objective is attained in a second aspect of the invention by an appliance for washing and rinsing goods, where some of the goods loaded into the appliance are sensitive to process water temperature changes. The appliance comprises a user interface, a controller, at least one temperature sensor, an inlet via which fresh water is supplied to a washing compartment of the appliance, and a controller. The controller is configured to receive, via the user interface, an instruction to execute a general-type washing programme, and a further instruction that the appliance during execution of the general-type washing programme should take into account that goods sensitive to temperature changes are loaded into the appliance, control the at least one temperature sensor to measure a temperature value in the washing compartment of the appliance upon executing a draining process, and control, via the inlet, supply of fresh water to the washing compartment of the appliance. The controller is further configured to control the at least one temperature sensor to measure, when the fresh water has been supplied, whether the process water being accommodated in a sump of the appliance is at a target temperature value or not, the target temperature value being defined to assume a value in a predetermined temperature range around the temperature value in the washing compartment measured during the draining process, and if not to adjust the temperature of the process water in the sump to attain the target temperature value, wherein the process water can be applied to the goods being sensitive to process water temperature changes.

As previously discussed, executing a specific "fragile-glass" washing programmes is undesirable since a user tends to load one or two handfuls of fragile glasses into the washing compartment and then run the specific glass-washing programme (or some other suitable program for delicate goods). This results an underutilization of the capacity of the dishwasher in relation to the energy consumed, and is thus not environmental-friendly.

With the invention, a user selects a general-type washing programme such as "Automatic 55-65° C." by operating a user interface thereby instructing a controller—e.g. a microprocessor—of the dishwasher to have the dishwasher carry out the selected programme. Thereafter, a "glassware option" is selected again by operating the user interface.

The controller will control a draining process to commence (regardless of whether the washing compartment comprises water or not) and a temperature $T_M$ in the washing compartment will be measured, either by using a sump temperature sensor or a compartment temperature sensor located above the sump.

As in any washing programme, fresh water will be supplied to the dishwasher via a water inlet as controlled by the controller when the washing programme commences and fill up the sump before being circulated in the washing compartment through a circulation pump via wash arms spraying the process water onto the goods to be cleaned.

In case the fresh water supplied to the washing compartment and mixed with the process water in the sump is cold, the process water accommodated in the sump will slowly be heated by a heater controlled by the controller as the process water is circulated in the washing compartment to finally reach an appropriate temperature.

Alternatively, hot water is supplied which already may have the appropriate temperature, or may have a higher temperature than that stipulated by the programme, in which case it will be gradually cooled down when being circulated in the washing compartment.

However, with the invention, assuming that the instantaneous washing compartment temperature sample is $T_M$=20° C.; then the temperature of the glassware may be assumed to be at that temperature as well (or at least close to 20° C.).

The process water being mixed in the sump with the fresh water being supplied to the washing compartment will as a consequence not be circulated, or at least not applied to the glassware, until it has reached a target temperature $T_T$, which target temperature is about the same as the measured temperature $T_M$=20° C. It should be noted that the target temperature $T_T$ may deviate from the measured temperature $T_M$. Advantageously, the fragile glassware has not experienced any rapid temperature changes.

In this particular example, the appropriate temperature is in the indicated range 55-65° C. as stipulated by the selected general-type washing programme.

Hence, the heater will be controlled by the controller such that the process water being circulated in the dishwasher slowly will be heated to have a temperature of at least 55° C. Now, since the temperature of the process water being circulated in the washing compartment has been slowly raised from 20° C. to 55° C., the fragile glassware will not experienced any rapid temperature changes.

As the process water is increasingly soiled, the washing compartment will have to be drained (at least partly) on process water by a drain pump, and fresh water will again have to be supplied via the water inlet.

In the art when executing the general-type washing programme, the fresh water—which may have a temperature as low as 10° C.—is supplied to the washing compartment via the water inlet and circulated through the circulation pump and the wash arms. Eventually, after having passed through the sump and the heater, the process will have reached the appropriate temperature.

However, for the temperature-sensitive glassware, this process may be devastating and cause damage to the glassware, which holds a temperature of in the range of 55-65° C. in this example and is sprayed with considerably colder water.

Advantageously, with the invention, the controller controls the heater to heat the process water to a target temperature of, say, 55° C. before is it applied to the fragile glassware, any rapid temperature changes are avoided.

In an embodiment, if the controller determines that the process water accommodated in the sump is above the target temperature value, the controller will conversely cool the process water to the target temperature value before applying the process water to the fragile glassware. Typically, the controller will see to it that the process water is retained in the sump until its temperature has decreased to the appropriate target temperature and thus advantageously can be applied to the glassware.

In yet an embodiment, the target temperature value is defined as the temperature value in the washing compartment measured during draining +/−10%, or the temperature value in the washing compartment measured during draining $+/-_5$%, or the temperature value in the washing compartment measured during draining +/−1%.

In a further embodiment, the controller controls circulation of the process water via a lower wash arm of the dish washer, thereby applying the process water to goods accommodated in a lower rack only, before the temperature of the process water has attained the target temperature value.

Advantageously, the process water is circulated in the washing compartment via the lower wash arm and thereby applied only to the goods being accommodated in the lower rack until the target temperature $T_T$ has been reached. Hence, any goods sensitive to temperature changes can be placed in an upper rack.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
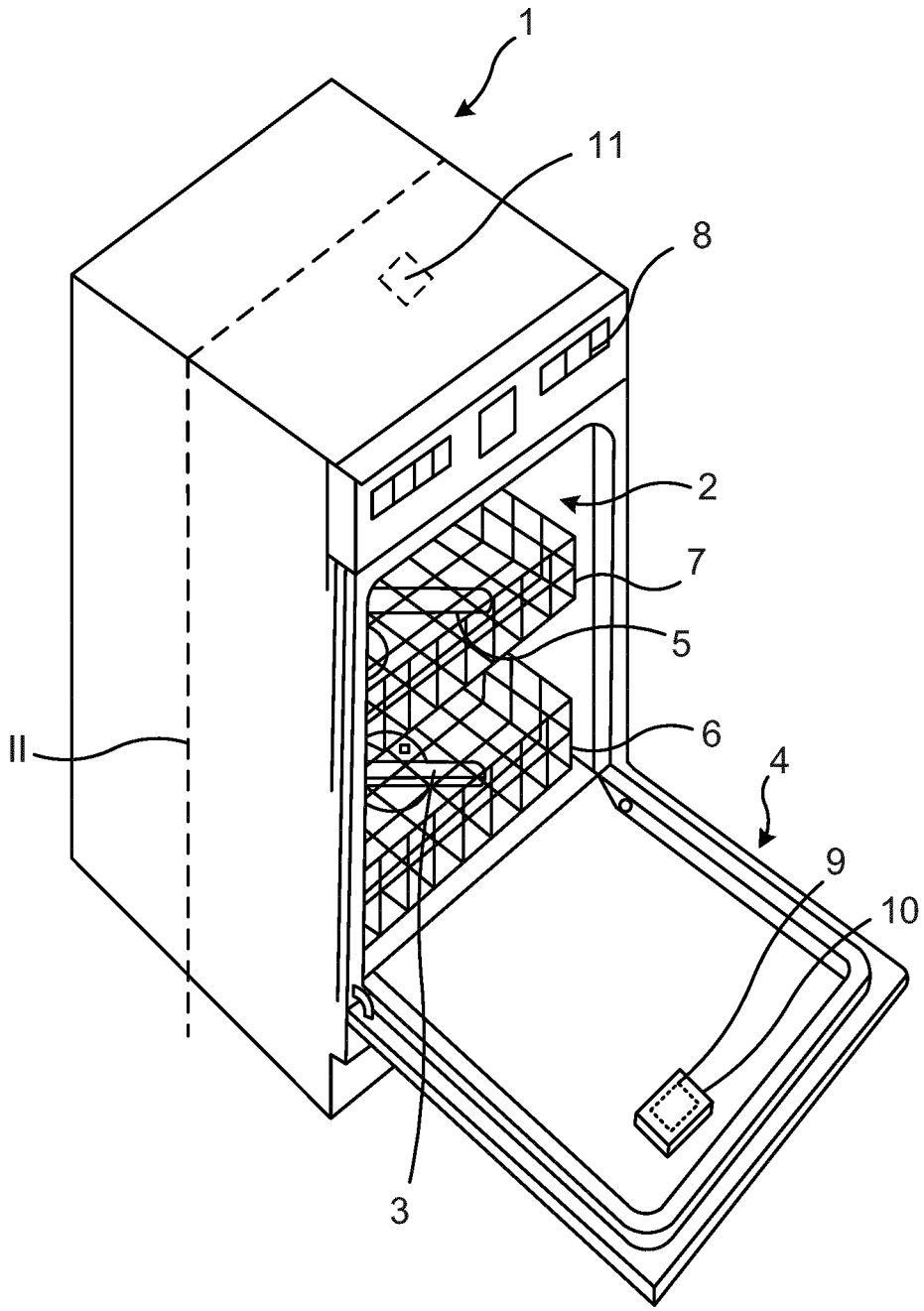
FIG. 1 shows a prior art dishwasher in which the present invention may be implemented.

FIG. 1 shows a prior art appliance for washing and rinsing goods in the form of a dishwasher 1 in which the present invention can be implemented. It should be noted that dishwashers can take on many forms and include many different functionalities. The dishwasher 1 illustrated in FIG. 1 is thus used to explain different embodiments of the present invention and should only be seen as an example of a dishwasher in which the present application can be applied.

The exemplifying dishwasher 1 comprises a washing compartment or tub 2, a door 4 configured to close and seal the washing compartment 2, a spraying system having a lower wash arm 3 and an upper wash arm 5, a lower rack 6 and an upper rack 7. Additionally, it may comprise a specific top rack for cutlery (not shown). A controller 11 such as a microprocessor is arranged in the interior of the dishwasher for controlling washing programmes and is communicatively connected to an interface 8 via which a user can select washing programmes.

The door 4 of the prior art dishwasher 1 illustrated in FIG. 1 is further on its inside arranged with a small detergent dispenser 9 having a lid 10 being controllably opened and closed by the controller 11 for dispensing detergent from the dispenser 9 into the washing compartment 2.

Figure 2:
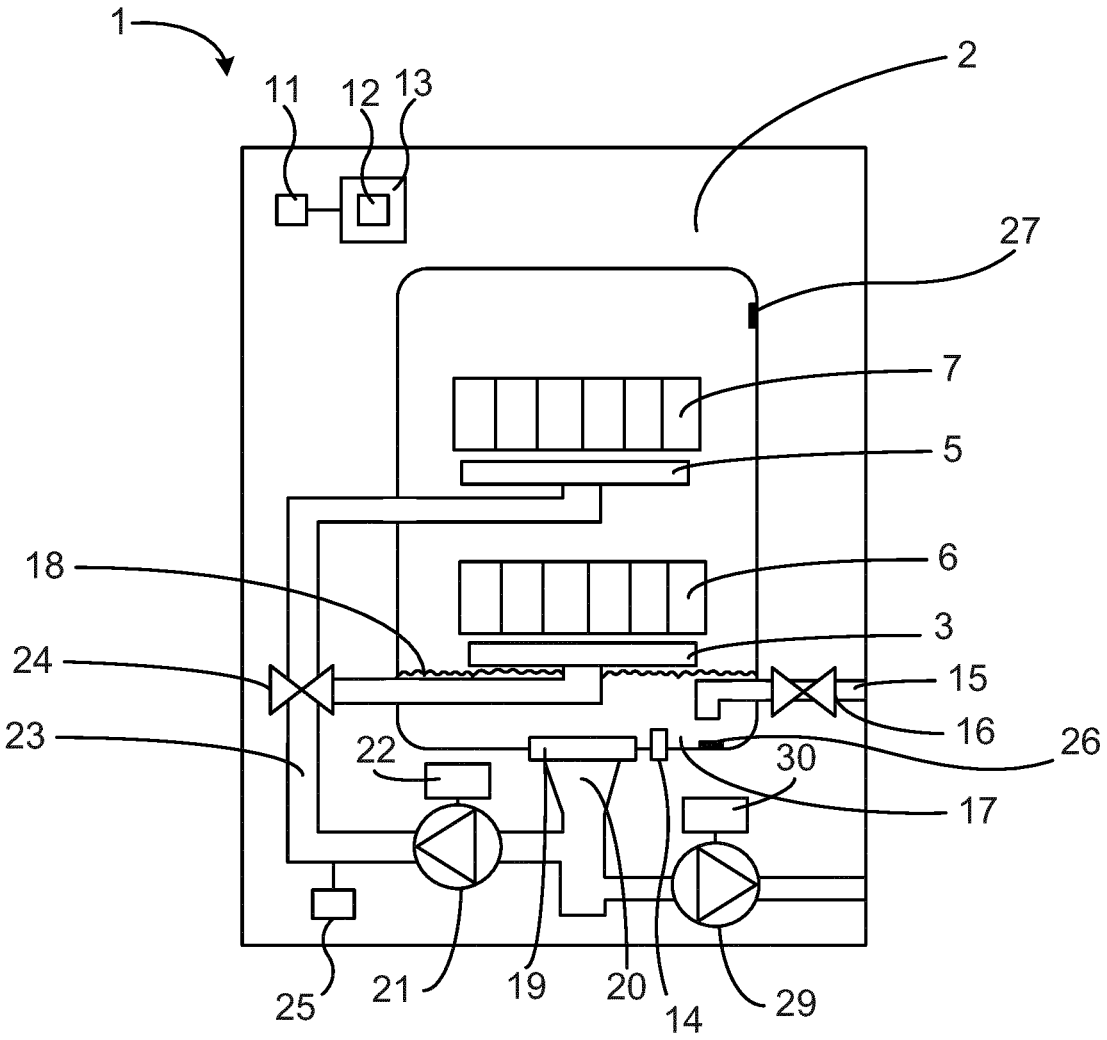
FIG. 2 schematically illustrates a cross-sectional view of the dishwasher of FIG. 1 taken along section II.

FIG. 2 schematically illustrates a cross-sectional view of the dishwasher 1 of FIG. 1 taken along section II, to further illustrate components included in a dishwasher 1. Hence, as previously mentioned, the dishwasher 1 comprises a washing compartment or tub 2 housing an upper basket 7 and a lower basket 6 for accommodating goods to be washed such as cutlery, plates, drinking-glasses, trays, etc.

Detergent in the form of liquid, powder or tablets is dosed in a detergent compartment located on the inside of a door (not shown in FIG. 2) of the dishwasher 1 by a user, which detergent is controllably discharged into the washing compartment 2 in accordance with a selected washing programme. As previously mentioned, the operation of the dishwasher 1 is typically controlled by the controller 11 executing appropriate software 12 stored in a memory 13.

Fresh water is supplied to the washing compartment 2 via water inlet 15 and water supply valve 16. This fresh water is eventually collected in a so called sump 17, where the fresh water is mixed with the discharged detergent resulting in process water 18. The opening and closing of the water supply vale 16 is typically controlled by the controller 11.

By the expression "process water" as used herein, is meant a liquid containing mainly water that is used in and circulates in a dishwasher. The process water is water that may contain detergent and/or rinse aid in a varying amount. The process water may also contain soil, such as food debris or other types of solid particles, as well as dissolved liquids or compounds. Process water used in a main wash cycle is sometimes referred to as the wash liquid. Process water used in a rinse cycle is sometimes referred to as cold rinse or hot rinse depending on the temperature in the rinse cycle. The pressurized fluid supplied to the detergent dispensing device according to embodiments of the invention thus at least partly contains process water.

At the bottom of the washing compartment 2 is a filter 19 for filtering soil from the process water before the process water leaves the washing compartment via process water re-circulation outlet 20 for subsequent re-entry into the washing compartment 2 through circulation pump 21. Thus, the process water 18 passes the filter 19 and is pumped through the circulation pump 21, which typically is driven by a brushless direct current (BLDC) motor 22, via a duct 23 and process water valve 24 and sprayed into the washing compartment 2 via nozzles (not shown) of a respective wash arm 3, 5 associated with each basket 6, 7. Thus, the process water 18 exits the washing compartment 2 via the filter 19 and is recirculated via the circulation pump 21 and sprayed onto the goods to be washed accommodated in the respective basket via nozzles of the wash arms 3, 5. Further, a controllable heater 14 is typically arranged in the sump 17 for heating the process water 18 to an appropriate temperature as measured by a sump temperature sensor 26. The dishwasher may further be equipped with a compartment temperature sensor 27 located above the sump 17.

The washing compartment 2 of the dishwasher 1 is drained on process water 18 with a drain pump 29 driven by a BLDC motor 30. It should be noted that it can be envisaged that the drain pump 29 and the circulation pump 21 may be driven by one and the same motor.

Figure 3:
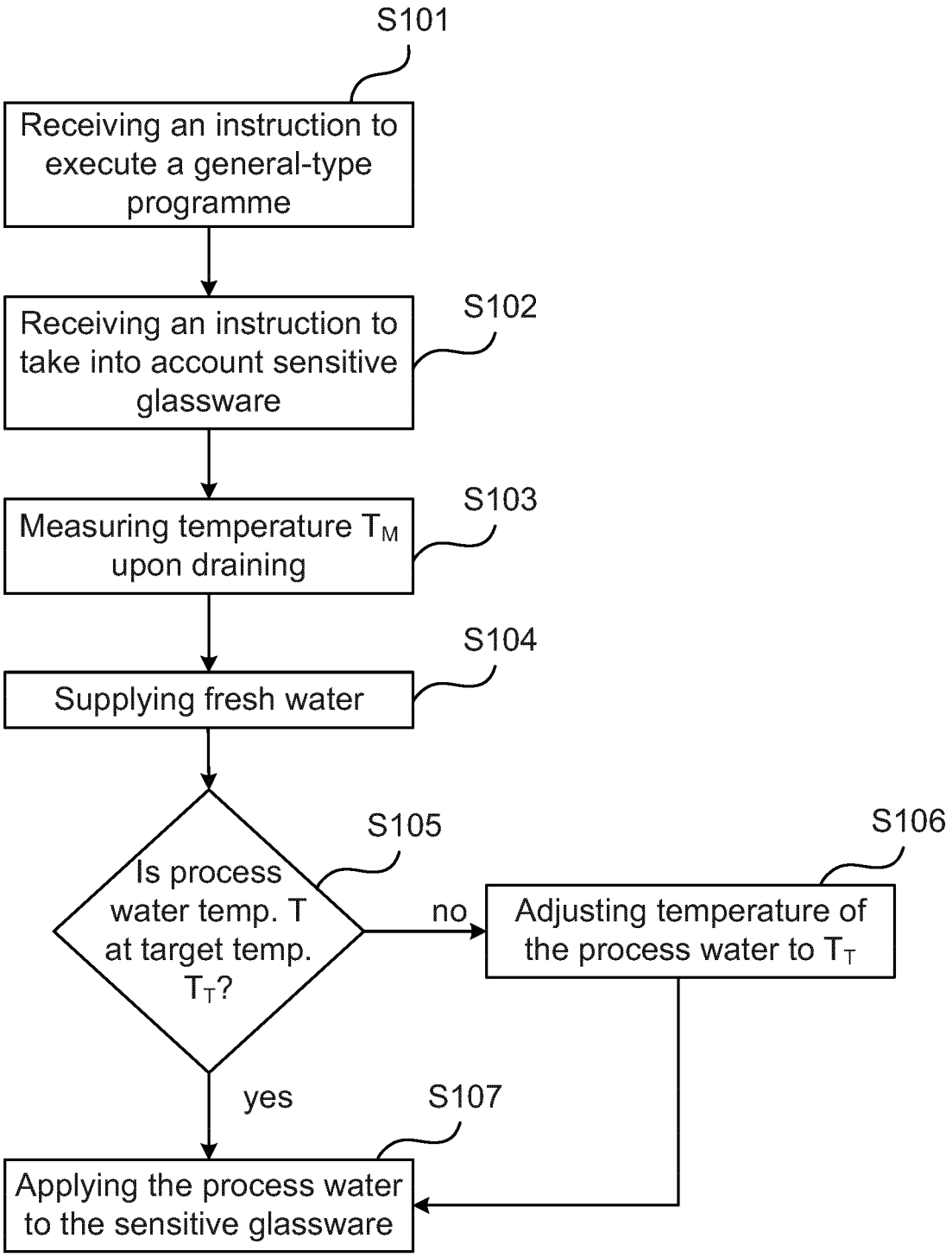
FIG. 3 illustrates a flowchart describing a method according to an embodiment of executing a washing programme taking into account that goods sensitive to temperature changes are loaded into the washing compartment of the dishwasher.

FIG. 3 illustrates a flowchart describing a method according to an embodiment of executing a washing programme taking into account that goods sensitive to temperature changes—such as for instance fragile glassware—are loaded into the washing compartment of the dishwasher.

Now, as previously discussed, executing a specific washing programmes is undesirable since a user tends to load one or two handfuls of fragile glasses into the washing compartment and then run the specific glass-washing programme (or some other suitable program for delicate goods). This results an underutilization of the capacity of the dishwasher in relation to the energy consumed, and is thus not environmental-friendly.

In this embodiment, a user selects a general-type washing programme such as "Automatic 55-65° C." or "EasyWash 50° C." by operating the user interface 8 in step S101 thereby instructing the controller 11 to have the dishwasher 1 carry out the selected programme. Thereafter, a "glassware option" is selected in step S102 again by operating the user interface 8. Alternatively, the two selections are made in the reverse order.

A draining process will commence (regardless of whether the washing compartment comprises water or not) and a temperature $T_M$ in the washing compartment will be measured in step S103, either by using the sump temperature sensor 26 or the compartment temperature sensor 27. In this particular example, $T_M$=20° C. Hence, a temperature value will be measured in the washing compartment 2 of the dishwasher 1 upon executing a draining process.

As in any washing programme, fresh water will be supplied to the dishwasher via water inlet 15 and water supply valve 16 as the washing programme commences and fill up the sump 17 before being circulated in the washing compartment 2 through circulation pump 21 via the wash arms 3, 5 spraying the process water onto the goods to be cleaned. In case the fresh water supplied to the washing compartment 2 and mixed with the process water 18 in the sump 17 is cold, the process water 18 accommodated in the sump 17 will slowly be heated by the heater 14 as it is circulated in the washing compartment 2 to finally reach an appropriate temperature. Alternatively, hot water is supplied which already may have the appropriate temperature, or may have a higher temperature than that stipulated by the programme, in which case it will be gradually cooled down when being circulated in the washing compartment 2.

However, with the invention, since the instantaneous washing compartment temperature sample is $T_M$=20° C.; then the temperature of the glassware may be assumed to be at that temperature as well (or at least close to).

The process water 18 being mixed in the sump 17 with the fresh water being supplied to the washing compartment will as a consequence not be circulated or at least not applied to the glassware until it has reached a target temperature $T_T$, which target temperature is about the same as the measured temperature $T_M$=20° C. It should be noted that the target temperature $T_T$ may deviate from the measured temperature $T_M$, as will be discussed in subsequent embodiments. Advantageously, the fragile glassware has not experienced any rapid temperature changes.

In this particular exemplifying embodiment, it is assumed that the washing programme "Automatic 55-65° C." is selected and hence the appropriate temperature is in the indicated range 55-65° C. Hence, the heater 14 will be controlled by the controller 11 such that the process water being circulated in the dishwasher slowly will be heated to have a temperature of at least 55° C. Now, since the temperature of the process water 18 being circulated in the washing compartment 2 has been slowly raised from 20° C. to 55° C., the fragile glassware will not experienced any rapid temperature changes.

As the process water 18 is increasingly soiled, the washing compartment will have to be drained (at least partly) on process water 18 by the drain pump 29, and fresh water will again have to be supplied via water inlet 15 and water supply valve 16.

In the art when executing the general-type washing programme, the fresh water—which may have a temperature as low as 10° C.—is supplied to the washing compartment 2 via water inlet 15 and water supply valve 16 and circulated through the circulation pump 21 and the wash arms 3, 5. Eventually, after having passed through the sump 17 and the heater 14, the process will have reached the appropriate temperature.

However, for the temperature-sensitive glassware, this process may be devastating and cause damage to the glassware, which holds a temperature of in the range of 55-65° C. in this example and is sprayed with considerably colder water.

Figure 4:
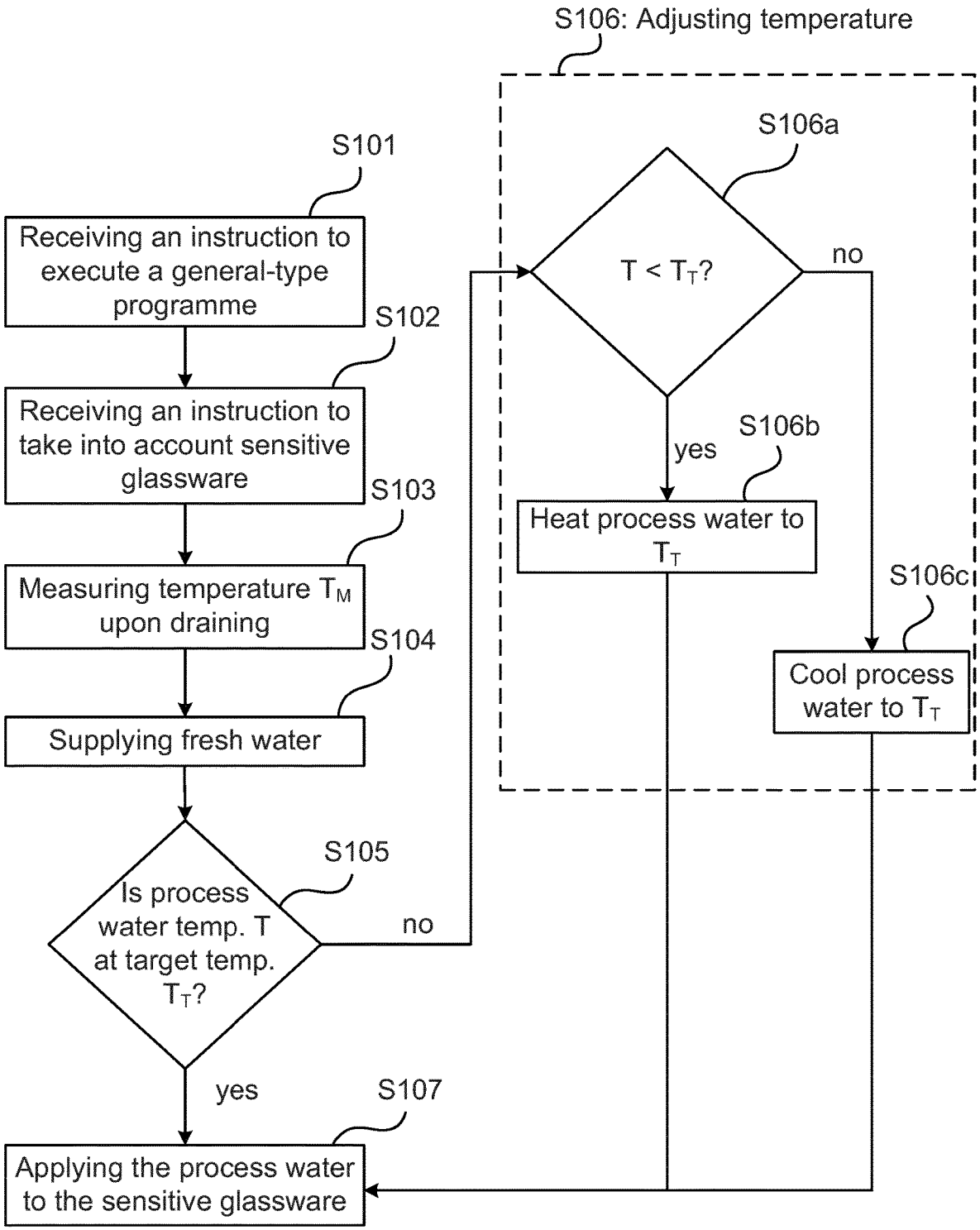
FIG. 4 illustrates a flowchart describing a respective embodiment where cold and hot water are supplied to the dish washer running the washing programme as discussed with reference to FIG. 3.

FIG. 4 illustrates a flowchart describing a respective embodiment where cold and hot water are supplied to the dish washer running the washing programme as discussed with reference to FIG. 3, and temperature-adjusted accordingly before being applied to the sensitive glassware.

In this particular exemplifying embodiment, it will first be assumed that cold fresh water is supplied to the dishwasher 1 already running the "Automatic 55-65° C." washing programme, in order to compensate for soiled process water 18 being drained from the dishwasher 1. Thereafter, an example is given here hot fresh water is supplied to the dishwasher 1.

In this embodiment, as previously has been described, a user has selected general-type washing programme "Automatic 55-65° C." by operating the user interface 8 in step S101 thereby instructing the controller 11 to have the dishwasher 1 carry out the selected programme, and further "glassware option" in step S102.

As the process water 18 is increasingly soiled, the washing compartment will have to be drained (at least partly) on process water 18 by the drain pump 29, and fresh water will again have to be supplied via water inlet 15 and water supply valve 16.

With the selected "glassware option", when the process water 18 is drained, the temperature sensor 26 arranged in connection to the sump 17 instantly measures the temperature $T_M$ of the process water 18 in the sump 17, or the compartment temperature sensor 27 measures the temperature $T_M$ of the air circulating in the washing compartment 2, in step S103.

Now, assuming that the instantaneous temperature sample is $T_M$=60° C.; then the temperature of the glassware may be assumed to be at that temperature as well (or at least close to).

The process water 18 being mixed in the sump 17 with the fresh water being supplied to the washing compartment in step S104—which in this example is assumed to have a temperature of 10° C.—will as a consequence not be circulated until it has reached a target temperature $T_T$ as determined in step s105, which target temperature preferably is slightly lower than the measured temperature $T_M$=60° C. since during the time elapsing for the draining, the filling and the subsequent heating of process water 18, the glassware will slightly cool off.

Consequently, since the temperature T of the process water 18 is below the target temperature $T_T$ due to the cold fresh water being supplied as determined in step S106*a*, the process water 18 will be heated by the heater 14 and re-circulated in the washing compartment 2 via the circulation pump 21 and the wash arms 3, 5 once it reaches the appropriate target temperature, say $T_T$=55° C., as measured by the sump temperature sensor 26. Hence, step S107 of applying the process water to the glassware is not performed until the target temperature $T_T$ has been reached.

However, it may also be envisaged that the process water 18 is heated to a target temperature $T_T$ slightly above the measured temperature $T_M$ before being applied to the sensitive glassware, such as e.g. 62-65° C., as long as the temperature of the process water after being heated does not cause a too great instant temperature change.

Thus, the cold fresh water being supplied to the sump 17 will result in that the heater 14 will heat the process water 18 in the sump 17 to a target temperature $T_T$ assuming a value in a predetermined temperature range ΔT around the measured temperature $T_M$ of the process water 18 in the sump 17 during draining.

Hence, $T_T=T_M+/-\Delta T$, where ΔT for instance may be 10% of $T_M$ to avoid any excessive temperature swings. Thus, if $T_T$=60° C., ΔT=6° C., and the heated process water 18 would after draining be applied to the sensitive glassware if the target temperature $T_T$ is somewhere in the range 54° C.-66° C.

If a more strict temperature control is desired, ΔT could be as low as, say, 1° C.

As is understood, if the temperature of the process water 18 is at 55° C. when being applied to the glassware, the process water 18 may slowly be heated to any required temperature as stipulated by the general-type washing programme, for instance to 60° C.-65° C.

Conversely, hot fresh water may be supplied to the dishwasher, say around 80° C., as determined in step S106*a*, i.e. the temperature T of the process water is above the target temperature $T_T$ due to the hot fresh water being supplied.

If the instantaneous temperature sample at draining again is $T_M$=60° C.; then again the temperature of the glassware may be assumed to be at that temperature as well (or at least close to).

The hot fresh water supplied to the washing compartment 2 may result in a too high instant temperature of the process water 18 in the sump 17.

The process water 18 being mixed in the sump 17 with the fresh water being supplied to the washing compartment 2 will as a consequence not be circulated until it has reached a target temperature $T_T$, which target temperature preferably is slightly lower than the measured temperature $T_M$=60° C. since during the time elapsing for the draining, the filling and the subsequent heating of process water 18, the glassware will slightly cool off.

Consequently, the heater 14 is turned off to have the process water 18 slightly cool down in step S106*c* to the appropriate target temperature, say $T_T$=55° C., as measured by the temperature sensor 26, before being re-circulated in the washing compartment 2 via the circulation pump 21 and the wash arms 3, 5.

Again, it may also be envisaged that the process water 18 is cooled down to a target temperature $T_T$ slightly above the measured temperature $T_M$ before being applied to the sensitive glassware, such as e.g. 62-65° C., as long as the temperature of the process water after being heated does not cause a too fast (and too great) instant temperature change.

Thus, the hot fresh water being supplied to the sump 17 will result in that the heater turned off and the process water 18 in the sump 17 will eventually cool down to a target temperature $T_T$ assuming a value in a predetermined temperature range ΔT around the measured temperature $T_M$ of the process water 18 in the sump 17 during draining.

Again, $T_T=T_M+/-\Delta T$, where ΔT for instance may be 10% of $T_M$ to avoid any excessive temperature swings. Thus, if $T_T$=60° C., ΔT=6° C., and the heated process water 18 would after draining be applied to the sensitive glassware if the target temperature $T_T$ is somewhere in the range 54° C.-66° C.

Advantageously, with the invention, the delicate glassware will not be subjected to any rapid temperature changes, regardless of whether hot or cold fresh water is being supplied to the dishwasher.

In an embodiment, again with reference to FIG. 4, after the cold or hot fresh water has been supplied to the dishwasher 1 in step S104, it may take some time to either heat the process water 18 in step S106*b*, or to cool the process water 18 in step S106*c*. Therefore, the process water 18 is circulated in the washing compartment 2 via the lower wash arm 3 and thereby applied only to the goods being accommodated in the lower rack 6 until the target temperature $T_T$ has been reached. Hence, any goods sensitive to temperature changes can be placed in the upper rack 7.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A method performed by an appliance for washing and rinsing goods, where some of the goods loaded into the appliance are sensitive to process water temperature changes, comprising:

receiving via a user interface, an instruction to execute a general-type washing program;

receiving via the user interface, a further instruction that the appliance during execution of the general-type washing program should take into account that goods sensitive to temperature changes are loaded into the appliance, wherein a programmed washing temperature associated with the general-type washing program prior to executing a draining process is the same in an instance in which the further instruction to take into account that goods sensitive to temperature changes are loaded into the appliance is received as in an instance in which the further instruction to take into account that goods sensitive to temperature changes are loaded into the appliance is not received;

measuring a temperature value in a washing compartment of the appliance upon executing the draining process;

supplying fresh water to the washing compartment of the appliance;

measuring, when the fresh water has been supplied, whether the process water being accommodated in a sump of the appliance is at a target temperature value or not, the target temperature value being defined to assume a value in a predetermined temperature range around the temperature value in the washing compartment measured during the draining process; and if not adjusting the temperature of the process water in the sump to attain the target temperature value, wherein the process water can be applied to the goods being sensitive to process water temperature changes.

2. The method of claim 1, wherein the adjusting of the temperature of the process water in the sump to attain the target temperature value comprises:

determining that the process water being accommodated in the sump is below the target temperature value; and heating the process water being accommodated in the sump to the target temperature value.

3. The method of claim 1, wherein the adjusting of the temperature of the process water in the sump to attain the target temperature value comprises:

determining that the process water being accommodated in the sump is above the target temperature value; and cooling the process water being accommodated in the sump to the target temperature value.

4. The method of claim 1, wherein the target temperature value is defined as the temperature value in the washing compartment measured during draining +/−10%, or the temperature value in the washing compartment measured during draining +/−5%, or the temperature value in the washing compartment measured during draining +/−1%.

5. The method of claim 1, further comprising:

circulating the process water via a lower wash arm of the appliance, thereby applying the process water to goods accommodated in a lower rack only, before the temperature of the process water has attained the target temperature value.

6. The method of claim 1, wherein the target temperature value is lower than the temperature value in the washing compartment measured during the draining process to account for cooling of the goods following the draining process, and wherein the target temperature value is higher than a starting temperature of the fresh water.

7. A computer program product comprising a non-transitory computer readable medium, the non-transitory computer readable medium having computer-executable instructions for causing a device to perform steps recited in claim 1 when the computer-executable instructions are executed on a processing unit included in the device.

8. An appliance for washing and rinsing goods, where some of the goods loaded into the appliance are sensitive to process water temperature changes, the appliance comprising:

a user interface;

a controller;

at least one temperature sensor;

an inlet via which fresh water is supplied to a washing compartment of the appliance;

the controller being configured to receive, via the user interface, an instruction to execute a general-type washing program, and a further instruction that the appliance during execution of the general-type washing program should take into account that goods sensitive to temperature changes are loaded into the appliance, wherein a programmed washing temperature associated with the general-type washing program prior to executing a draining process is the same in an instance in which the further instruction to take into account that goods sensitive to temperature changes are loaded into the appliance is received as in an instance in which the further instruction to take into account that goods sensitive to temperature changes are loaded into the appliance is not received;

control the at least one temperature sensor to measure a temperature value in the washing compartment of the appliance upon executing the draining process;

control, via the inlet, supply of fresh water to the washing compartment of the appliance;

control the at least one temperature sensor to measure, when the fresh water has been supplied, whether the process water being accommodated in a sump of the appliance is at a target temperature value or not, the target temperature value being defined to assume a value in a predetermined temperature range around the temperature value in the washing compartment measured during the draining process; and if not to adjust the temperature of the process water in the sump to attain the target temperature value, wherein the process water can be applied to the goods being sensitive to process water temperature changes.

9. The appliance of claim 8, further comprising:

a heater; wherein the controller is configured to, when adjusting the temperature of the process water in the sump to attain the target temperature value:

determine that the process water being accommodated in the sump is below the target temperature value; and control the heater to heat the process water being accommodated in the sump to the target temperature value.

10. The appliance of claim 8, wherein the controller is configured to, when adjusting the temperature of the process water in the sump to attain the target temperature value:

determine that the process water being accommodated in the sump is above the target temperature value; and control circulation of the process water being accommodated in the sump such that the process water is cooled down to the target temperature value before being applied to the goods being sensitive to process water temperature changes.

11. The appliance of claim 8, wherein the target temperature value is defined as the temperature value in the washing compartment measured during draining +/−10%, or the temperature value in the washing compartment measured during draining +/−5%, or the temperature value in the washing compartment measured during draining +/−1%.

12. The appliance of claim 8, wherein the controller further is configured to:

control circulation of the process water via a lower wash arm of the appliance, thereby applying the process water to goods accommodated in a lower rack only, before the temperature of the process water has attained the target temperature value.

13. The appliance of claim 8, said appliance being a dish washer.

14. The appliance of claim 8, wherein the target temperature value is lower than the temperature value in the washing compartment measured during the draining process to account for cooling of the goods following the draining process, and wherein the target temperature value is higher than a starting temperature of the fresh water.

* * * * *